United States Patent [19]

Ibrahim

[11] 4,437,317

[45] Mar. 20, 1984

[54] HEAD PRESSURE MAINTENANCE FOR GAS DEFROST

[75] Inventor: Fayez F. Ibrahim, Niles, Mich.

[73] Assignee: Tyler Refrigeration Corporation, Niles, Mich.

[21] Appl. No.: 352,473

[22] Filed: Feb. 26, 1982

[51] Int. Cl.[3] ..... F25B 41/00; F25D 21/06

[52] U.S. Cl. ..... 62/81; 62/196.4; 62/278; 62/152; 62/156; 62/DIG. 17

[58] Field of Search ..... 62/81, 278, 277, 199, 62/200, 196 R, 196 B, 509, DIG. 17, 184, 151, 156, 152, 174, 149

[56] References Cited

U.S. PATENT DOCUMENTS

| | | | |
|---|---|---|---|
| 3,238,737 | 3/1966 | Shrader et al. | 62/509 X |
| 3,464,226 | 9/1969 | Kramer | 62/278 X |
| 4,122,686 | 10/1978 | Lindahl et al. | 62/81 |
| 4,167,102 | 9/1979 | Willitts | 62/81 X |
| 4,193,781 | 3/1980 | Vogel et al. | 62/81 |

*Primary Examiner*—Albert J. Makay

*Assistant Examiner*—Harry Tanner

*Attorney, Agent, or Firm*—LeBlanc, Nolan, Shur & Nies

[57] ABSTRACT

A closed circuit refrigeration system includes a compressor, a remote condenser connected to the output of the compressor, and one or more evaporators coupled within the system. A hot gas defrost system is included to rapidly obtain a high operating defrost gas pressure upon the initiation of a defrost cycle and to thereafter maintain an adequate pressure for hot gas defrosting of the evaporators. The hot gas defrost system includes a differential pressure regulated valve which closes the compressor discharge line to shunt the hot gas discharge directly into a hot gas defrost manifold. The differential valve is controlled by a defrost control means. The refrigeration system can also include a receiver tank and a by-pass conduit for shunting refrigerant liquid through the by-pass conduit rather than through the receiver tank depending upon operating conditions. A method of operating a closed circuit refrigeration system with the above features is set forth.

49 Claims, 2 Drawing Figures

HEAD PRESSURE MAINTENANCE FOR GAS DEFROST

BACKGROUND OF THE INVENTION

The present invention relates to a closed cycle refrigeration system for use in a refrigerated display case. Means for maintaining a high head pressure to permit gas defrost are included and a simplified and low cost gas defrost feature for the evaporator coils located in the case is provided to improve efficiency of operation.

In the basic construction and operation of a closed cycle refrigeration system, gaseous refrigerant, e.g., freon, is compressed to a high temperature and pressure. The compressed gas is passed to a condenser where it is condensed to a liquid phase. The pressure within the condenser is maintained high enough that the condensing temperature is higher than the ambient air temperature. The liquid refrigerant may be temporarily stored in a receiver before being passed, through a metering device to reduce the liquid refrigerant pressure, to an evaporator located within a display case. As the liquid passes through the evaporator, it extracts heat from the display case and undergoes a phase change to the gaseous state. This low pressure gaseous refrigerant is supplied to the input side of the compressor where it is heated and compressed to a high pressure and the cycle is continued.

Traditionally, the condenser was operated at a preselected design temperature level. The design temperature for the condenser was generally determined as a function of the highest ambient temperature during a normal period of the warmest season in a particular area. The condenser was operated so as to condense the gaseous refrigerant at a temperature of at least 10° F. above this design temperature. Consequently, if the design temperature was 90° F., then the condenser temperature was set at 100° F.

Recognizing that the design temperature was only likely to occur a few days in a year, and then only during the day and not at night, the refrigeration systems have been modified so that the condenser temperature followed the path of the ambient temperature while always remaining at least 10° F. above the ambient temperature. Varying the condenser temperature to follow ambient conditions results in increased compressor capacity. The rule of thumb is that every 10° F. drop in the condenser temperature increases the compressor capacity by about 6%. Thus, if the condenser temperature drops from 100° to 75°, the compressor capacity will increase by about 15%. Simultaneously, the compressor consumption will be reduced, the compressor efficiency will increase, and the BTU/Watt of the compressor will increase. The combination effect is to increase compressor capacity and reduce power consumption, so that for every 10° F. drop in the condenser temperature, there will be approximately an 8% reduction in power consumption, assuming constant refrigeration load.

Another need in refrigeration systems is to provide for defrosting of the evaporator coils. A defrost cycle for this purpose can be actuated either at set periodic time intervals or when the defrost build-up within the system has reached a certain predetermined level. Such systems are typically thermostatically controlled so as to switch from a refrigeration cycle to a defrost cycle of operation. In this manner of operation it is possible to avoid any significant frost build-up within the evaporator coils such that inoperability of the refrigeration system would occur.

There have been three different approaches for defrosting refrigerated display cabinets in this art. These are, utilizing electric resistance heaters; passing a compressed refrigerant gas having a high specific heat through the refrigeration coils; and, circulating ambient air through an air conduit in which the refrigeration coils are positioned. In order to utilize a compressed refrigerant gas as a source for energy to be employed during a defrosting cycle it is necessary to construct the entire refrigeration system in a manner which permits the low energy-consumption functioning of the system in the manner above-described as well as to balance the pressures and temperatures at various points in the system so as to achieve an efficient gas defrost operation under a wide range of ambient conditions which are encountered in the locations in which such systems are used.

This invention relates to a refrigeration system for use in cooled display cases of the type which are used primarily in retail food and supermarket outlets in which a defrost feature is included for defrosting evaporator coils in an operative and thermally efficient manner.

During the operation of the refrigeration systems, it is necessary to regulate the pressure within the receiver in order to ensure proper operation of the evaporators. Such regulation has typically been provided by shunting hot gaseous refrigerant from the gas discharge line of the compressor directly into the receiver whenever the relative pressure of the receiver drops by more than a preselected pressure differential from the pressure in the gas discharge conduit. For such purposes, a check valve, typically set to respond to a pressure difference on the order of 20 or 30 psi as compared to the pressure in the gas discharge conduit the check valve opens and allows the hot gas from the gas discharge line to flow directly into the receiver. Since the gaseous refrigerant in the gas discharge conduit is typically of a temperature level of approximately 200° F., such gas acts as a significant heat source to the receiver, a situation which is generally undesirable.

During the refrigeration cycle, the refrigerant absorbs a substantial amount of heat during the evaporation stage, which heat is then dissipated by the condenser as a waste by-product of the refrigeration cycle. A technique for taking advantage of the heat to be dissipated by the hot gaseous refrigerant is the utilization of a heat recovery coil, such as shown in U.S. Pat. No. 4,123,914 issued Nov. 7, 1978, to Arthur Perez and Edward Bowman, and commonly assigned with the present invention. The disclosure of the Perez et al '914 patent is incorporated herein by reference. Such a heat recovery coil allows for extraction of heat from the gaseous refrigerant flowing out of the compressor before entering the remote condenser. Such extracted heat then can be utilized for heating the interior of the building where the refrigeration system is employed.

Especially in recent years, much attention has been directed to improving the efficiency of such refrigeration systems. The prior art is replete with discussions of various techniques for attempting to improve the operation of a refrigeration system. In large installations, such as supermarkets, there are typically large numbers of refrigerated display cases and a plurality of compressors are used to satisfy the heavy refrigeration load under certain conditions, such as during the warmer portions of the year. The efficiency of the compressors is dependent upon the compression ratio of the discharge side of the compressor to the suction side of the compressor. Thus, by reducing the head pressure at the compressor discharge, the efficiency of operation of the compressor can be increased. One such system, employing reduced head pressure to increase operating efficiency, is described in co-pending application Ser. No. 57,350, filed July 13, 1979, titled ENERGY SAVING REFRIGERATION SYSTEM, now U.S. Pat. No. 4,286,437, and commonly assigned with the present invention; the disclosure of said Ser. No. 57,350 is hereby incorporated by reference as though fully set forth herein.

One of the features of the low head pressure systems, particularly including the one described in the aforesaid application Ser. No. 57,350, is that the system is designed to subcool liquid refrigerant in the remote condenser. Liquid subcooling will increase the efficiency of the system since the refrigerant will extract 15–25% more heat per pound circulated. The rule of thumb is that for every 10° F. subcooling the system efficiency will increase by 5%. In substantially all commercial refrigeration systems, a receiver tank or surge tank is interposed between the condenser output and the liquid manifold supplying the evaporator coil. It has been found that, in systems employing a receiver tank, the refrigeration loses 10° to 15° F. of subcooling in passing through the receiver; that is, the temperature of the refrigerant in the receiver may rise 10° to 15° F. This results in a loss of efficiency since fewer BTU's of heat can be extracted from the air around the evaporator coils in the display case for each pound of refrigerant passing through the evaporator coil. One reason for this heat gain is that the receiver tank is generally located in the machinery room adjacent the compressor motors and related heat producing equipment. Some of this heat will be absorbed by the refrigerant in the receiver and the temperature of the refrigerant will rise accordingly.

Some commercial refrigerating systems attempt to avoid the problem of receiver tank heat gain by using a surge tank; one such surge tank system is shown in U.S. Pat. No. 3,905,202 issued Sept. 16, 1975 to Donald F. Taft et al. In a surge tank type of system, condensed liquid refrigerant flows directly from the condenser output to the case evaporators. The surge tank stores excess liquid refrigerant to assure continued operation under varying ambient conditions which result in a variation in the condensing capacity of the condensers. It has been found that, especially during hot weather operations, the closed circuit system may "die" because the surge tank pressure may run 35 to 40 psig lower than the condenser pressure, resulting in liquid refrigerant logging in the receiver and not being passed to the evaporator. This problem is particularly prone to occur during periods of abnormally high ambient temperature; at such times, the pressure in the condenser will correspond to an ambient temperature of 90° F. to 100° F., for example, whereas the surge tank temperature and thus pressure will be lower so that the refrigerant liquid will flow into the surge tank. The liquid thus tends to flow into the surge tank and create a logged condition which deprives the evaporators of refrigeration capacity during high ambient temperature conditions.

One design for providing hot gas defrost for a refrigeration system is shown in U.S. Pat. No. 4,012,921 to Willitts et al. In this patent a defrosting line is connected into a hot gas discharge line from the compressor. A series of defrost system valves are provided for controlling the flow of hot gas through the defrosting lines. The compressor discharge line has a pressure regulated valve therein which is responsive to the receiver pressure in order to maintain the defrost line pressure above the receiver pressure during both refrigeration and defrost cycles. In conditions where this valve remains open, e.g. when an adequate receiver pressure is being maintained, the system does not modulate the defrost gas pressure at the beginning of a defrost cycle. This results in a delay in the defrost cycle time under ambient conditions such as low temperature during which low head pressure can exist in the defrost gas line. Another problem is that this refrigeration system design does not protect against the system "dying" due to logging of the receiver during periods of abnormally high ambient temperature such as referred to above. Under this condition an inadequate flow of refrigerant in order to achieve specified levels of refrigeration in the evaporator coils can exist during those times periods when the refrigeration load is the highest. The operation of the main defrost gas valve dependent upon the receiver pressure would accentuate this type of problem during the refrigeration cycle functioning of the evaporator coils.

Another refrigeration system provided with hot gas defrost, but not having the increased efficiency features of the present invention is described in U.S. Pat. No. 4,276,755.

The present invention constitutes an improvement over prior art receiver tank and surge tank systems having provision for hot gas defrost. The present invention incorporates a hot gas defrost system which is responsively controlled by the initiation of a defrost cycle so that a high head pressure is immediately obtained in order to insure that the defrost gas will pass through selected evaporator(s) in the reverse direction from the refrigerant flow during the normal refrigeration cycle.

The improved system can also incorporate a by-pass conduit which permits subcooled liquid refrigerant to flow directly from the condenser to the evaporator coils under normal temperature conditions without first passing through the receiver tank. This arrangement will obtain a complete liquid flow in the conduit supplying the evaporator coils. Receiver designs with a single bottom-connecting conduit can result in a mixture of liquid and gas in the evaporator conduit because at high refrigeration loads the liquid is drained immediately from the condenser.

In one embodiment of the present invention, the receiver tank is configurated to have its input and output located at the bottom of the tank. The lower portion of the tank is insulated to minimize heat transfer from the machine room to the liquid refrigerant in the bottom portion of the receiver tank. Minimization of heat transfer to the liquid refrigerant is of important in order to maintain the subcooling condition achieved in the condenser.

SUMMARY OF THE INVENTION

The present invention relates to an improved closed circuit refrigeration system including a hot gas defrost system which is designed to rapidly obtain a high operating defrost gas pressure upon the initiation of a defrost cycle.

The hot gas defrost means includes a defrost control means which is operative to control valves in the refrigeration system for permitting gas defrost to be initiated and terminated selectively for various evaporator coils maintained within the system. The heat content of the hot gas is transferred through the evaporator coils to defrost the same.

A differential pressure regulated valve means is provided in the gas discharge line from the compressors for closing down the discharge line at the start of a defrost cycle so as to shunt the compressor hot gas discharge directly into the hot gas defrost manifold in order to quickly attain an operative defrost gas pressure. Upon the hot has defrost line exceeding a set point pressure this valve is set to modulate to various open positions in order to assure a defrost gas pressure of at least the set point value.

Another feature is that a by-pass means can be provided for by-passing the receiver when ambient conditions permit the remote condenser to adequately subcool the condensed refrigerant.

A by-pass conduit including a temperature controlled valve provides a by-pass around the receiver tank input and output; a temperature sensor senses the condenser output and the receiver input temperature. When the sensed temperature is below a preselected subcooling limit, the valve is opened to provide a low resistance flow path around the receiver directly to the liquid manifold. When the sensed temperature exceeds the preselected subcooling limit, the valve is closed and the refrigerant is directed into the receiver tank to flow therethrough in normal fashion.

Another feature of the present invention is that the refrigeration system pressure delivered to the evaporators is provided by connecting the output line from the remote condenser to the evaporator input liquid manifold through a controlled valve with the connection point to the receiver input line being upstream from the controlled valve and with a holdback regulator means positioned in the receiver input line downstream from the connection point.

Still another feature of the invention resides in the use of a check valve interposed in the condenser conduit upstream of the by-pass conduit to prevent backflow of refrigerant under conditions whereby the liquid manifold pressure exceeds the condenser pressure.

Still another feature of the invention resides in having the receiver tank input and output located at the bottom of the tank. The bottom portion of the receiver tank is insulated while the top part of the tank is exposed to the machinery room ambient. This arrangement permits surface refrigerant to boil off to maintain adequate systems pressure between the receiver and the evaporators.

It is therefore an object of the present invention to provide a closed circuit mechanical refrigeration system in which a hot gas defrost system is provided which operates at a high defrost gas pressure immediately upon initiation of a defrost cycle.

Another object is to provide a by-pass conduit which is connected between the receiver tank input and output conduits and is opened and closed responsive to the temperature of the refrigerant flowing in the closed circuit between the condenser output and receiver input.

Another object is to provide an improvement for a closed circuit refrigeration system of the type described herein.

Yet another object of the present invention is to provide a method of operating a closed circuit refrigeration system wherein a hot gas defrost system is arranged to attain a high operating pressure immediately upon the initiation of a defrost cycle and wherein a by-pass line can be optionally arranged between the receiver tank input and output so as to control the refrigerant flow dependent upon the temperature of the refrigerant sensed in the circuit connecting the condenser and the receiver input.

These and other objects of the present invention will be more fully described in the drawings and description of the present invention below.

DESCRIPTION OF THE PREFERRED EMBODIMENTS

Figure 1:
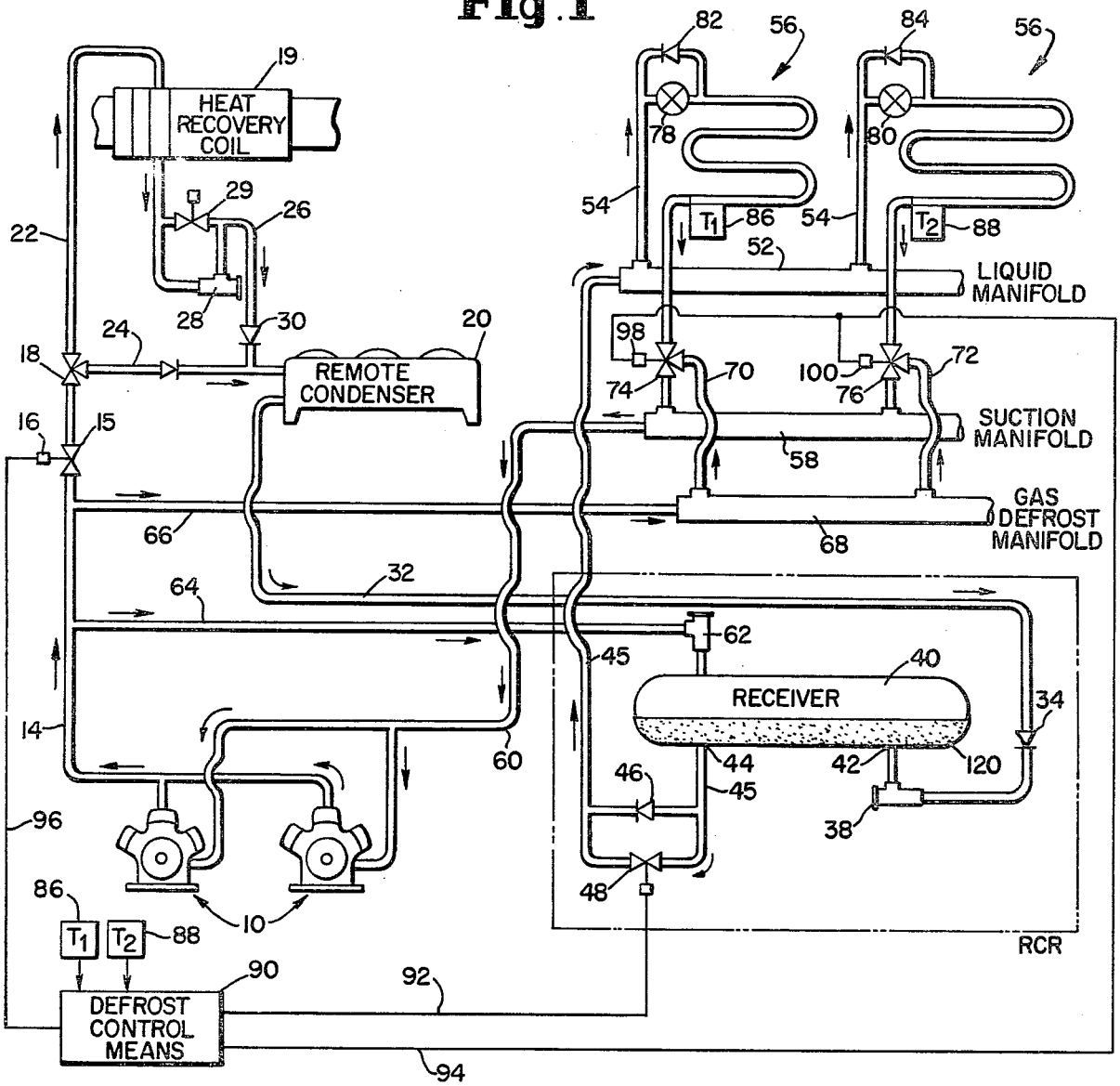
FIG. 1 shows a schematic diagram of a closed circuit refrigeration system incorporating the features of the invention including the hot gas defrost system.

The preferred embodiment of the present invention is described in the context of its use with a commercial refrigeration system manufactured by Tyler Refrigeration Corporation, assignee of the present invention, and sold by Tyler under the tradename SCOTCH TWOSOME and which commercial system is described in detail in Tyler Installation and Service Manual for Scotch Twosome Condensing Unit Assemblies REV. 5/78. In the Scotch Twosome assembly, a pair of compressors is connected in parallel, as shown, for example, in above-noted co-pending application Ser. No. 57,350. It should be understood, however, that the invention is not limited to the Scotch Twosome assembly; the present invention may be incorporated into and is applicable to many types of closed cycle refrigeration systems.

In a closed circuit refrigeration system of the type described herein, the "high side" refers to the high pressure side of the system (upstream of metering devices) or portion thereof. The liquid side of the system is generally considered to be between the outlet of the condenser and the metering devices. The low pressure gas side or "suction side" lies between the metering devices and the compressor. The metering devices referred to herein are the devices that control the flow of liquid refrigerant to the evaporators.

As illustrated in the drawing DRAWING 1, the refrigeration system includes compressor means 10 connected to a main compressor discharge gas conduit 14. A gas defrost differential pressure regulated valve 15 is positioned in conduit 14 to provide for the take-off of hot compressor discharge gas. Differential pressure regulated valve 15 is powered through a solenoid operator 16 to maintain an open position during a refrigeration cycle and to maintain a closed position during the initial defrost cycle during which the power to solenoid operator 16 is interrupted. The valve 15 is adjusted to a set point pressure and modulates to a range of open positions dependent upon the pressure in conduit 14 when above the predetermined setpoint pressure level in conduit 14. Also, solenoid operated three-way heat recovery valve 18 may be advantageously interposed in conduit 14 of the main refrigeration circuit downstream from valve 15 to selectively connect a heat recovery coil 19 in series flow relationship with a remote condenser 20. The solenoid operator can be controlled dependent on the availability of excess heat energy in the system. Condenser 20 advantageously includes a plurality of fans controlled by ambient conditions, as described, for example in aforementioned Ser. No. 57,350. Valve 18 connects conduit 14 to the upstream side of coil 19 through a heat recovery branch conduit 22 and to the upstream side of remote condenser 20 through a conduit 24. The downstream side of heat recovery coil 18 is connected to conduit 24, and thus remote condenser 20, by a conduit 26 containing a pressure regulator 28 and a solenoid valve 29 containing pressure regulator 28 and a solenoid valve 29 arranged in parallel and a check valve 30. Valve 29 is controlled by the heat load required to be produced by coil 19. For low loads the heat recovery coil is operated at 70° to 80° F. and valve 29 is maintained in open position. At higher loads the valve 29 is closed which forces the refrigerant flow through the regulator 28 to shift the pressure and temperature upward. The higher load coil temperature range can be 90° to 100° F.

The downstream side of remote condenser 20 is connected through a conduit 32, a check valve 34, and a holdback or upstream pressure regulator 38 to the bottom of receiver tank 40. Unlike conventional designs, the receiver tank 40 of this invention has both its inlet 42 and outlet 44 located at the bottom of the tank 40.

A receiver outlet conduit 45 is connected through a forward direction check valve 46 and a defrost control valve 48 arranged in parallel therewith. Conduit 45 is, in turn, connected to a liquid manifold 52. One or more liquid lines 54 connect the liquid manifold 52 to each of one or more remotely located evaporators 56 associated, for example, with respective refrigerated display cases or cold rooms, generally positioned in a store such as a supermarket. The liquid manifold 52 and lines 54 can be arranged in a number of circuits having two or more evaporators 56 per circuit. The low side of each evaporator returns to a suction manifold 58 which in turn is connected through a return line 60 to the intake of compressor means 10.

Proper operation of the closed circuit refrigeration system requires that the pressure of the refrigerant be maintained at an appropriately preselected minimum pressure level, depending on the type of refrigerant used, the operating conditions, and the size of the system. Pressure in the receiver tank 40 is maintained by a pressure regulator valve 62 interposed in a conduit 64 which connects the output of compressor 10 with the top of receiver 40. Hot gaseous refrigerant at the compressor output pressure can thus be supplied through conduit 64 and pressure regulator valve 62 to the receiver 40 whenever the pressure in the receiver tank 40 drops below a preselected level. For example, valve 62 may be set to open when the pressure in the receiver 40 drops below 120 psig for refrigerant R-502 or below 55 psig for refrigerant R-12.

The present invention includes a hot gas defrost subsystem for which the defrost hot gas take-off conduit 66 is provided in order to connect the compressor discharge 14 with the gas defrost manifold 68. Hot gas defrost conduits 70 and 72 are connected to three-way solenoid operated valves 74 and 76 respectively which are located in the suction side of the evaporator coils 56. The evaporators 56 are provided with expansion valves 78 and 80 which are also provided with parallel arranged check valve lines 82 and 84 respectively. Temperature sensors 86 and 88 are also provided on the suction side of evaporators 56.

A defrost control means 90, shown in schematic representation, receives signals from temperature sensors 86 and 88 and can also be constructed with an internal timer as well. These temperature and/or time signal inputs are used to initiate defrost cycles during which various control valves are actuated and/or deactuated by the defrost control means 90. Either electrical control or fluid control lines can be employed for this purpose. In the specific embodiment herein described electrical control conductors 92, 94 and 96 are provided for operating the various defrost control valves.

Line 92 operates valve 48 in the receiver outlet conduit 45. During the refrigeration cycle valve 48 is maintained in open position and in defrost it is closed by operation of the defrost control means and thereafter is controlled responsive to the liquid refrigerant temperature at the suction side of the evaporators by means of the temperature sensors 86 and 88, also designated as $T_1$ and $T_2$, respectively. Three-way valves 74 and 76 are controlled via line 94 through solenoid operators 98 and 100, respectively. If desired independent control of each of the three-way valves 74 and 76 can also be provided by utilizing separate lines for the single lines 94 as shown.

One of the features of the present invention is the operation of the gas defrost differential pressure regulated valve 15 which is controlled by line 96 leading from the defrost means 90 to the solenoid operator 16. During the refrigeration cycle solenoid operator 16 is powered in order to maintain valve 15 in open position. At the initiation of the defrost cycle the control means 90 terminates power to conductor 96 and valve 15 is closed. This valve 15 is set to open at a predetermined set point pressure and to thereafter further open responsive to the refrigerant gas pressure in conduit 14. For example, the valve 15 can be set at 200 psi which is equivalent to 95° F. refrigerant temperature for refrigerant 502. A setting of 110 psi, equivalent to 96° F., can be employed for refrigerant R-12.

The purpose of differential pressure regulated valve 15 and solenoid operator 16 together with hot gas take-off line 66 is to assure a quick pressure rise in gas defrost manifold 68 at the initial part of a defrost cycle sufficient to reverse the flow of refrigerant through the evaporators 56 and flush the same with hot defrost gas in the reverse flow direction in order to quickly defrost the evaporators 56. The pressure attained in the defrost gas manifold 68 in this manner is sufficient to cause the reverse flow of hot defrost gas through the evaporator coils against the pressure of the refrigeration liquid maintained in the liquid manifold 52 which is supplied from the receiver tank 40. In this manner thawing of food products stored in display cases refrigerated by the refrigeration system described will not occur. Differential valve 15 is responsive for its operation to the state of the refrigeration system, and specifically to the initiation of a defrost cycle. It is not responsive to the refrigerant pressure in the receiver 40. If valve 15 were omitted the defrost gas pressure in take-off line 66 would rise slowly under certain conditions and could require as long as 30 minutes in order to reach a pressure adequate to reverse the flow of refrigerant in the evaporators 56. At low ambient temperatures of, for example, 0° F. the pressure in conduit 14 at the initiation of a defrost cycle could be as low as 50 psi. Approximately 10 minutes would then be required to obtain the required 200 psi operating pressure in the gas defrost manifold 68. During this time the refrigeration functioning of the evaporators is severely hampered by the accumulated frost and ice.

The refrigeration system described herein can be employed for maintaining the refrigeration requirements for eight or more evaporator circuits. The liquid manifold 52 transfers liquid refrigerant condensed in selected evaporators 56 during their defrost cycles to the evaporators in the refrigeration mode of operation over the same time period. Normally, about 25% of the evaporators are in defrost during any one time period, i.e. two evaporators out of a total of eight in a typical system. Due to this transfer of liquid through manifold 52, flow of liquid refrigerant from the receiver 40 is not normally needed but check valve 46 provides for a flow to the liquid through the manifold 52 when the pressure in receiver 40 is 15 to 30 psig above the liquid manifold pressure. At times of high liquid refrigerant demand, this flow will occur. The check valve 46 is selected to operate within this pressure differential range.

The receiver portion of the refrigeration system shown in FIG. 1 which has been designated therein by the subsystem box RCR can be replaced by an alternate receiver subsystem which provides an additional beneficial operating capability in the event of low ambient temperatures. As such low temperatures for remote condenser 20 functioning, the refrigerant will be subcooled and the receiver 40 can be by-passed and the liquid taken directly to the liquid manifold for use in the evaporators 56. At higher ambient temperatures the liquid can be forced through the receiver 40 where it is cooled additionally due to the relatively lower temperature of the machine room in which the receiver is stored. To provide for this additional benefit, the receiver subsystem shown in FIG. 2 can be employed as a replacement within the box RCR. According to this arrangement, a by-pass line 102 is coupled between Tee connections 104 and 106 which are interposed in refrigerant conduits 32 and 45 respectively. Connection Tee 104 is also employed to connect conduit 32 with the pressure regulator 38 and connection Tee 106 is used to connect the receiver output conduit 45 with the by-pass line 102.

Figure 2:
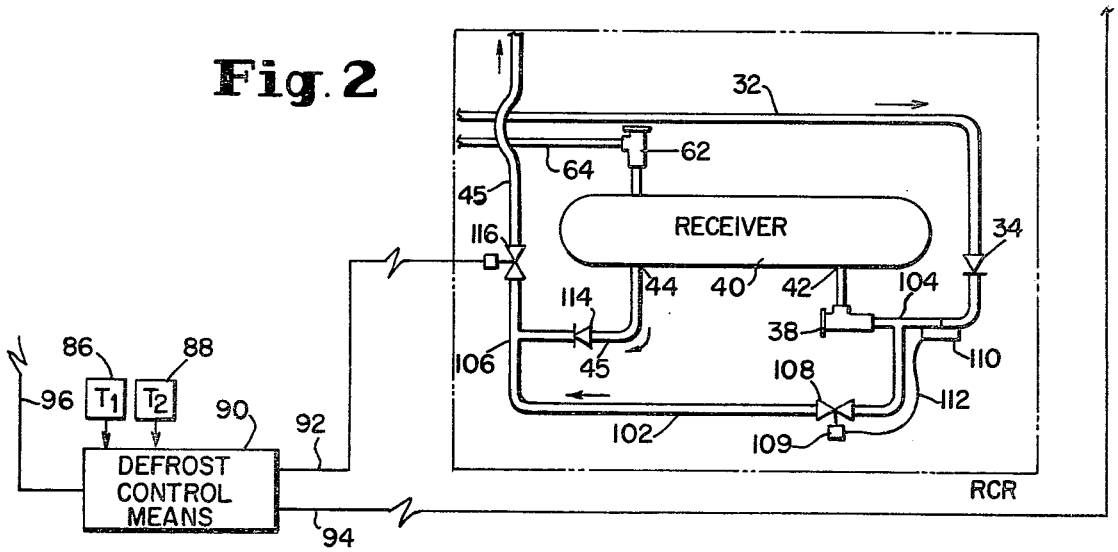
FIG. 2 shows an alternative receiver by-pass arrangement which can be employed for the receiver portion of the system shown in FIG. 1.

A temperature operated solenoid valve 108 is interposed in by-pass conduit 102 to control the flow of refrigerant therethrough as a function of the temperature of the liquid refrigerant in conduit 32 which connects remote condenser 20 to the receiver tank 40. A temperature sensor 110 is provided for this purpose and is connected via conductor 112 to the solenoid operator 109 of valve 108. In FIG. 2, the identification numerals of FIG. 1 have been employed for the identical components described with reference to that FIG. 1.

Liquid refrigerant from the remote condensor 20 passes through holdback regulator 38 which establishes and maintains a desired condenser head pressure, depending on such factors as the type of refrigerant used and the system ambient design conditions. From the holdback regulator 38, the liquid refrigerant flows into receiver 40 through bottom inlet 42, and flows into receiver 40 through bottom inlet 42, and flows along the bottom of the receiver to the bottom outlet 44 located at or near the opposite end of the tank from inlet 42.

A one-way valve 114 is interposed in receiver outlet conduit 45 in order to isolate the receiver tank 40 during the refrigeration mode when the by-pass solenoid valve 108 is open and subcooled liquid refrigerant at the system head pressure is flowing through conduit 102 to the liquid manifold 52. Preferably and advantageously, the receiver by-pass system head pressure is maintained at about 90 psig for refrigerant R-12 and at about 135 psig for refrigerant R-502.

A liquid defrost differential valve 116 is interposed in conduit 45 and is controlled by line 92 from the defrost control means 90. Valve 116 is open during a refrigeration cycle and closed during a defrost cycle unless the defrost liquid pressure in the conduit 45 rises above a predetermined set point. In this event the valve 116 in conduit 45 modulates to a range of open positions dependent upon the pressure to allow the liquid to pass through Tee connection 106. For such operation valve 116 is adjusted to a set point pressure of 15 to 30 psig above the liquid manifold pressure. This establishes a pressure differential between the receiver 40 and the liquid manifold 52 to insure that the defrost liquid will flow from the evaporators 56 to the manifold 52 which is remotely located in a machine room. Conductors 94 and 96 function as described in reference to FIG. 1 above.

The remote condenser 20 is usually located in an exterior environment exposed to outside ambient conditions, such as on the roof of a store. At certain times of the year, such as fall, winter and spring seasons, and/or in certain geographic regions, such as the northern half of the United States, the ambient temperature conditions are sufficiently low that hot gaseous refrigerant entering the remote condenser 20 is completely condensed and subcooled (below the condensing temperature for the refrigerant in use) within the condenser itself so that refrigerant flowing through conduit 32 is subcooled before entering receiver 40. The temperature sensor 110 of FIG. 2 senses the temperature of the subcooled liquid refrigerant flowing through conduit 32. When the sensed temperature is below a predetermined set point, again determined as a function of the type of refrigerant, size of the system, etc., valve 108 is opened to complete a low resistance refrigerant flow path from the outlet of condenser 20 through conduits 32 and 102 to the inlet side of liquid manifold 52. In this way, subcooled liquid refrigerant at the system head pressure flows directly from condenser 20 to the expansion valves or similar metering device, associated with each of the respective evaporator coils 56. The predetermined or preselected set point temperature can be about 60° F. so that the liquid refrigerant will pass through the receiver 40 when its temperature is above this point.

The check valve 34 located in conduit 32 between the outlet remote condenser 20 and the Tee connection 104 operates in conjunction with the holdback regulator 38 when receiver tank pressure is low to maintain condenser flooding, thereby assuring system head pressure and subcooling within the condenser. The check valve 34 offers a means of providing adequate head pressure for feeding the expansion valves of the respective evaporators 56.

The check valve 34 prevents refrigerant from flowing back to the condenser from the evaporators during off cycle periods of the compressors 10. It has been found that, on occasion, during off cycle periods of the compressor means 10, particularly in systems incorporating gas defrost, such as shown, for example, in U.S. Pat. No. 4,276,755, issued July 7, 1981, titled GAS DEFROST SYSTEM INCLUDING HEAT EXCHANGE, and commonly assigned with the present invention, that the refrigerant in manifold 52 will be at a higher temperature and pressure than the refrigerant in condenser 20. The design of regulator 38 is such that it has a relatively slow response time under back pressure conditions. Thus, regulator 38 will be slow to close when the refrigerant pressure on the downstream side of regulator 38 exceeds the refrigerant pressure on the upstream side thereof. A back flow condition will therefore occur for a substantial period of time whereby relatively high temperature refrigerant will flow back to condenser 20, thereby reducing its effectiveness. The check valve 34 is therefore employed to prevent such back flow from occurring during the off cycle phases of the compressor means 10.

The check valve 34 assumes added importance in connection with the pressed invention since, when solenoid valve 108 is held open, back flow could readily occur through by-pass conduit 102, in the absence of check valve 34.

When the temperature of the condensed refrigerant rises above the range of subcooling, solenoid operated valve 108 will close and the condensed refrigerant will be directed into the receiver tank 40. This is to ensure an adequate supply of refrigerant during the condensing mode when total condensing surface is being utilized, with little or no flood back control, allowing for a reserve liquid supply (in the receiver). This is particularly useful in those systems with refrigerant control by thermostat and solenoid, requiring pump down after temperature satisfaction within the display case fixture or during defrosting of the case fixture.

Unlike conventional refrigeration systems, the present invention as embodied in FIG. 2 permits the delivery of refrigerant under pressure to the evaporators 56 by means of the connection of the condenser output line 32 to the liquid manifold 52 through the controlled valve 108. Thus refrigerant, under the above described conditions is permitted to by-pass the receiver 40. The connection of the receiver inlet line 42 to condenser output conduit 32 at Tee connection 104 is upstream from valve 108 and the holdback regulator 38 is thus located downstream from that connection Tee 104.

The use of a receiver tank having both the inlet and outlet located at the bottom is based on a recognition of the fact that the receiver tank is generally located in a mechanical machine room where it is exposed normally to temperatures ranging between about 65° F. and about 90° F. The bottom portion of the receiver tank is covered by insulation jacket 120 to minimize the heating of the subcooled liquid refrigerant flowing through the receiver tank. The top portion of the receiver tank is exposed to the machine room ambient temperature, usually no lower than 65° F. This results in a corresponding pressure in the tank equivalent to about 125 psig or above where refrigerant R-502 is used.

The overall efficiency of the refrigeration system described with reference to FIGS. 1 and 2 contains subsystems to provide improved efficiency both at abnormally low ambient temperatures and at abnormally high ambient temperatures. As described above, the gas defrost subsystem is operative to quickly create an operating head pressure in order to efficiently effect gas defrost of the evaporators 56 even at abnormally low ambient temperature which causes the system pressure to drop. By means of the receiver by-pass line 102 and the associated subsystem the problem described above in which the receiver tank 40 can log with refrigerant liquid at abnormally high ambient temperatures is also overcome. The absence of a control linkage between the receiver tank pressure and the differential pressure regulated valve 15 which controls the gas defrost pressure permits efficient functioning of both the refrigeration cycle and the gas defrost cycle without interconnection of the operating abnormalities in either of the two principal modes of operation.

The terms receiver tank and receiver means as used in the specification and claims hereof include surge tanks, accumulators, hold tanks, etc., used for retaining liquid refrigerant flowing between the condenser the liquid manifold in a closed cycle mechanical refrigeration system.

The invention may be embodied in other specific forms without departing from the spirit or essential characteristics thereof. The present embodiment is therefore to be considered in all aspects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a refrigeration system having a compressor means for compressing refrigerant fluid, a compressor discharge conduit for conducting compressed refrigerant gas to a condenser means in which the compressed refrigerant gas is condensed to a liquid; and an evaporator means connected between said condenser means and said compressor means to provide refrigeration by evaporating liquid refrigerant from said condenser means and for returning the refrigerant gas formed to the intake of said compressor means; the improvement comprising:

defrost conduit means for selectively conducting gaseous refrigerant during a defrost cycle from said compressor discharge conduit to said evaporator means for defrosting said evaporator means;

a selectively controllable valve means connected in said compressor discharge conduit downstream from the connection of said defrost conduit means to said discharge conduit and upstream from said condenser means, said controllable valve means operably maintained in substantially opened position during a refrigeration cycle; and an operator associated with said selectively controllable valve means for closing said valve means at the start of a defrost cycle for immediately increasing the pressure of the refrigerant gas within said defrost conduit means up to a predetermined level at the start of a defrost cycle, and said controllable valve means operable thereafter for substantially maintaining by modulation an increased pressure in said defrost conduit means throughout said defrost cycle.

2. The improvement according to claim 1, wherein said selectively controllable valve means includes motive means for closing said valve at the start of a defrost cycle, and means responsive to the refrigerant gas pressure in said defrost conduit means for opening said valve as a function of the compressor discharge pressure above a predetermined pressure level and for modulating said valve to substantially maintain a pressure of at least the predetermined pressure in said defrost conduit means during a defrost cycle.

3. The improvement according to claim 1, wherein said refrigeration system contains a liquid receiver connected between said condenser means and said evaporator means, and refrigerant conduit means coupled between said receiver means and said evaporator means, and a controllable valve connected in said refrigerant conduit means for closing said conduit means at the start of a defrost cycle and for thereafter selectively permitting refrigerant flow.

4. The improvement according to claim 2, wherein said valve in said refrigerant conduit means enables flow of liquid refrigerant from said receiver to said evaporator means during a refrigeration cycle of operation.

5. The improvement according to claim 1, wherein said evaporator means is coupled to said defrost conduit means through at least one three-way valve located in the low pressure side of said evaporator means.

6. The improvement according to claim 1, 4 or 5 in which a defrost control means is operably connected to said controllable valves for controlling the operation thereof at the start and end of a defrost cycle.

7. The improvement according to claim 1, wherein a defrost control means is operably connected to said selectively controllable valve means which is in turn comprised of a differential pressure regulated valve.

8. The improvement according to claim 3, wherein a defrost control means is operably connected to said controllable valve for controlling operation thereof at the start and end of a defrost cycle of operation.

9. The improvement according to claim 5, wherein a defrost control means is operably connected to said three-way valve for controlling operation of same at the start and end of a defrost cycle of operation.

10. The improvement according to claim 7, 8 or 9, wherein said defrost control means is operably connected to temperature sensors arranged on the suction side of said evaporator means for monitoring the evaporator refrigerant gas temperature.

11. The improvement according to claim 1, wherein said refrigeration system contains a heat recovery coil arranged in parallel refrigerant flow relationship to said compressor discharge conduit upstream of said condenser means and downstream from said means for increasing the pressure of the refrigerant gas.

12. The improvement according to claim 3, wherein a liquid manifold is provided in said refrigerant conduit means downstream from said controllable valve and wherein a check valve is interposed in said refrigerant conduit means to permit outflow from said receiver at a predetermined pressure differential between said receiver and said liquid manifold.

13. The improvement according to claim 12, wherein said check valve is arranged in parallel with said controllable valve and wherein said controllable valve is maintained in open position during a refrigeration cycle and is closed at the start of a defrost cycle.

14. The improvement according to claim 3, wherein a liquid manifold is provided in said refrigerant conduit means downstream from said controllable valve and wherein said controllable valve in said refrigerant conduit means is a differential valve operable to maintain an open position during a refrigeration cycle and to close at the start of a defrost cycle and to controllably open during a defrost cycle as a function of the differential liquid refrigerant pressure between said receiver and said liquid manifold.

15. The improvement according to claim 14, wherein a by-pass conduit is connected between a point upstream from said receiver to a point upstream from said differential valve and having located therein a valve means for selectively controlling the flow of refrigerant through said by-pass conduit and said receiver, respectively, as a function of the condition of the refrigerant downstream of said condenser means.

16. The improvement according to claim 15, wherein said controllable valve in said by-pass conduit enables flow of liquid refrigerant directly from said condenser to said evaporator means during ambient conditions in which the refrigerant liquid from said condenser means is outside of a preselected subcooled state.

17. The improvement according to claim 15, wherein said valve means for selectively controlling the flow of refrigerant includes means for sensing the temperature of refrigerant between the condenser means and said by-pass conduit and for opening said by-pass conduit to allow refrigerant to by-pass said receiver means when the sensed refrigerant temperature is at or below a preselected subcooled temperature and for closing said by-pass conduit to direct the flow of refrigerant to said receiver means when said sensed refrigerant temperature is above said preselected subcooling temperature.

18. The improvement according to claim 15, wherein said valve means for selectively controlling the flow of refrigerant further comprises valve means coupled with a temperature sensing means for opening and closing the refrigerant flow path through said by-pass conduit, respectively, in response to the sensed refrigerant temperature.

19. The improvement according to claims 17 or 18, further comprising means for substantially preventing reverse flow of refrigerant to said condenser means when the system pressure downstream of said receiver means exceeds the pressure in said condenser means.

20. The improvement according to claim 15, wherein an inlet conduit for said receiver means is connected to the output of said condenser means at a connection point upstream from said valve means for selectively controlling the flow of refrigerant through said by-pass conduit, and wherein a holdback regulator means is positioned in said receiver means inlet conduit downstream from said connection point.

21. The improvement according to claims 14 in which a defrost control means is operably connected to said differential valve for controlling operation thereof at the start and end of a defrost cycle.

22. The improvement according to claim 14, wherein a check valve is interposed in said refrigerant conduit means between said receiver and said differential valve and is operable to permit outflow of refrigerant from said receiver upon occurrence of a predetermined pressure differential between said receiver and said liquid manifold.

23. A refrigeration system having a compressor means for compressing refrigerant fluid, a compressor discharge conduit for conducting compressed refrigerant gas to a condenser means; and an evaporator means connected between said condenser means and said compressor means to provide refrigeration and to return the refrigerant gas formed to said compressor means; comprising:

defrost conduit means for selectively conducting refrigerant gas during a defrost cycle from said compressor discharge conduit to said evaporator means and for defrosting said evaporator means;

means for defrosting said evaporator means; and a selectively controllable valve means connected in said compressor discharge conduit downstream from the connection of said defrost conduit means to said discharge conduit and upstream from said condenser means, said controllable valve means operably maintained in substantially open position during a refrigeration cycle; and an operator associated with said selectively controllable valve means for closing said valve means at the start of a defrost cycle for immediately increasing the pressure of the refrigerant gas within said defrost conduit means up to a predetermined level at the start of a defrost cycle, and said controllable valve means operable for substantially maintaining by modulation an increased pressure in said defrost conduit means throughout said defrost cycle for supply of defrost gas at an increased pressure to said means for defrosting said evaporator means.

24. The refrigeration system according to claim 23, wherein said valve means includes motive means for closing said valve at the start of a defrost cycle, and means responsive to the refrigerant gas pressure in said defrost conduit means for opening said valve as a function of the compressor discharge pressure above a predetermined pressure level and for modulating said valve to substantially maintain a pressure of at least the predetermined pressure in said defrost conduit means during a defrost cycle.

25. The refrigeration system according to claim 23, wherein said refrigeration system contains a liquid receiver connected between said condenser means and said evaporator means, and refrigerant conduit means coupled between said receiver means and said evaporator means, and a controllable valve connected in said refrigerant conduit means for closing said conduit means at the start of a defrost cycle and for thereafter selectively permitting refrigerant flow.

26. The refrigeration system according to claim 25, wherein said controllable valve in said refrigerant conduit means enables flow of liquid refrigerant from said receiver to said evaporator means during a refrigeration cycle of operation.

27. The refrigeration system according to claim 23, wherein said evaporator means is coupled to said defrost conduit means through at least one three-way valve located in the low pressure side of said evaporator means.

28. The improvement according to claims 23, 26 or 27 in which a defrost control means is operably connected to said controllable valves for controlling the operation thereof at the start and end of a defrost cycle.

29. The refrigeration system according to claim 23, wherein a defrost control means is operably connected to said selectively controllable valve means, and wherein said valve means comprises a differential pressure regulated valve means.

30. The refrigeration system according to claim 25, wherein a defrost control means is operably connected to said controllable valve for controlling operation thereof at the start and end of a defrost cycle of operation.

31. The refrigeration system according to claim 27, wherein a defrost control means is operably connected to said three-way valve for controlling operation of the same at the start and end of a defrost cycle of operation.

32. The refrigeration system according to claim 25, wherein a liquid manifold is provided in said refrigerant conduit means downstream from said controllable valve and wherein a check valve is interposed in said refrigerant conduit means to permit outflow from said receiver at a predetermined pressure differential between said receiver and said liquid manifold.

33. The refrigeration system according to claim 32, wherein said check valve is arranged in parallel with said controllable valve and wherein said controllable valve is maintained in open position during a refrigeration cycle and is closed at the start of a defrost cycle.

34. The refrigeration system according to claim 25, wherein a liquid manifold is provided in said refrigerant conduit means downstream from said controllable valve and wherein said controllable valve in said refrigerant conduit means is a differential valve operable to maintain an open position during a refrigeration cycle and to close at the start of a defrost cycle and to controllably open during a defrost cycle as a function of the differential liquid refrigerant pressure between said receiver and said liquid manifold.

35. The refrigeration system according to claim 34, wherein a by-pass conduit is connected between a point upstream from said receiver to a point upstream from said differential valve and has located therein a valve means for selectively controlling the flow of refrigerant through said by-pass conduit and said receiver, respectively, as a function of the condition of the refrigerant downstream of said condenser means.

36. The refrigeration system according to claim 35, wherein said controllable valve in said by-pass conduit enables flow of liquid refrigerant directly from said condenser to said evaporator means during ambient conditions at which the refrigerant liquid from said condenser means is outside of a preselected subcooled state.

37. The refrigeration system according to claim 35, wherein said valve means for selectively controlling the flow of refrigerant includes means for sensing the temperature of refrigerant between the condenser means and said by-pass conduit and for opening said by-pass conduit to allow refrigerant to by-pass said receiver means when the sensed refrigerant temperature is at or below a preselected subcooled temperature and for closing said by-pass conduit to direct the flow of refrigerant to said receiver means when said sensed refrigerant temperature is above said preselected subcooling temperature.

38. The refrigeration system according to claim 35, wherein said valve means for selectively controlling the flow of refrigerant further comprises valve means coupled with a temperature sensing means for opening and closing the refrigerant flow path through said by-pass conduit, respectively, in response to the sensed refrigerant temperature.

39. The refrigeration system according to claims 36 or 37, further comprising means for substantially preventing reverse flow of refrigerant to said condenser means when the system pressure downstream of said receiver means exceeds the pressure in said condenser means.

40. The refrigeration system according to claim 35, wherein an inlet conduit for said receiver means is connected to the output of said condenser means at a connection point upstream from said valve means for selectively controlling the flow of refrigerant through said by-pass conduit, and wherein a hold back regulator means is positioned in said receiver means inlet conduit downstream from said connection part.

41. The method of operating a refrigeration system having a compressor means for compressing refrigerant gas, a discharge line for conducting gas from said compressor means, condenser means connected by said discharge line, and evaporator means coupled between condenser means and said compressor means to provide refrigeration by evaporating liquid refrigerant from said condenser means and returning the refrigerant gas formed therein to the intake of said compressor means, said method comprising the steps of:

during a refrigeration cycle of operation passing refrigerant gas from the compressor means through the discharge line to the condenser means and then through the evaporator means and returning refrigerant gas to the compressor means;

during a defrost cycle of operation initially preventing flow of refrigerant gas into the condenser means and thereafter preventing flow of refrigerant gas at any pressure below a predetermined setpoint pressure and above this pressure modulating the flow of refrigerant gas into the condenser means in response to the discharge line pressure, during a defrost cycle immediately conducting refrigerant gas flowing in the discharge line into the evaporator means to defrost the same; and conducting the defrost refrigerant liquid formed during a defrost cycle within the evaporator means to a liquid manifold means provided within said refrigeration system.

42. A method according to claim 41, in which a liquid receiver is connected between said condenser and said evaporator means, said receiver having a refrigerant conduit means connected between said receiver means and said evaporator means, and a controllable valve connected in said refrigerant conduit means for selectively permitting refrigerant flow; the method comprising the additional steps:

controlling said controllable valve to maintain said valve in open position during a refrigeration cycle of operation and for closing said valve during a defrost cycle of operation.

43. A method according to claim 41, in which said refrigeration system has a selectively controlled by-pass conduit means connected between the condenser means and the receiver means which has valve means therein for selectively controlling the flow of refrigerant, and wherein said method comprises the additional steps of:

sensing the condition of the refrigerant in the output of the condenser means; and controlling the refrigerant flow in the by-pass conduit means as a function of the refrigerant fluid temperature in the condenser means output in order to permit refrigerant to flow from the condenser means directly to evaporator means under selected operating condition.

44. The method according to claim 43, wherein said controlling step comprises opening the by-pass conduit means against flow of refrigerant when the sensed temperature is below the preselected temperature, and comprising the additional step conducting the refrigerant flow in the outlet of the condenser means into the receiver means.

45. The method according to claims 43 or 44, wherein the preselected temperature is about 60° F.

46. The method according to claim 43, wherein said controlling step comprises preventing the reverse flow of refrigerant to the condenser means when the system pressure downstream of the receiver means exceeds the pressure in the condenser means.

47. The method according to claim 43, wherein a hold back regulator means is positioned between the receiver means and the connection point of receiver means and the output of the condenser means, and wherein said method comprises the additional step of establishing a predetermined refrigerant pressure in said condenser output through adjustment of the holdback regulator means.

48. The improvement according to claim 1, wherein said selectively controllable means is comprised of a differential pressure regulated valve.

49. The refrigeration system according to claim 23, wherein said selectively controllable valve means is comprised of a differential pressure regulated valve.

* * * * *